US005514857A

United States Patent [19]

Corless

[11] Patent Number: 5,514,857

[45] Date of Patent: May 7, 1996

[54] ACCESS CONTROL SYSTEM

[75] Inventor: Anthony R. Corless, Ash, England

[73] Assignee: Central Research Laboratories Limited, Middlesex, England

[21] Appl. No.: 362,417

[22] PCT Filed: May 19, 1994

[86] PCT No.: PCT/GB94/01072

§ 371 Date: Dec. 27, 1994

§ 102(e) Date: Dec. 27, 1994

[87] PCT Pub. No.: WO94/27257

PCT Pub. Date: Nov. 24, 1994

[30] Foreign Application Priority Data

May 19, 1993 [GB] United Kingdom ..... 9310284

[51] Int. Cl.[6] ..... G07B 15/02

[52] U.S. Cl. ..... 235/384; 235/382

[58] Field of Search ..... 235/384, 382

[56] References Cited

U.S. PATENT DOCUMENTS 3,501,622 3/1970 Weir et al. ..... 235/384
3,748,441 7/1973 Halpern ..... 235/384
3,958,103 5/1976 Oka et al. ..... 235/384
3,984,660 10/1976 Oka et al. ..... 235/384 X

FOREIGN PATENT DOCUMENTS 1372180 10/1974 United Kingdom .

*Primary Examiner*—Donald T. Hajec
*Assistant Examiner*—Jeffrey R. Filipek
*Attorney, Agent, or Firm*—Keck, Mahin & Cate

[57] ABSTRACT

An access control system for a public transport system comprises, at each entrance/exit location (1) of the transport system, at least one entrance gate (12) provided with a ticket reader (8), at least one exit gate (20) provided with a ticket reader (16), a ticket issuing machine (22) and a local data processor (10) with which the other items communicate. The local processors (10) communicate via a central processor (14). The tickets bear unique identification codes which are stored, upon issue, in the local processors (10) at the location (1) at which they are valid for entry. Upon entry using a ticket the relevant code is cancelled at all locations and then it is stored again in the local processors (10) at those locations (1) at which it is valid for exit. Upon exit using a ticket the relevant code is cancelled at all locations. If entry or exit is attempted at a location (1) at which the relevant code is not stored, the relevant gate (12 or 20) is barred.

2 Claims, 1 Drawing Sheet

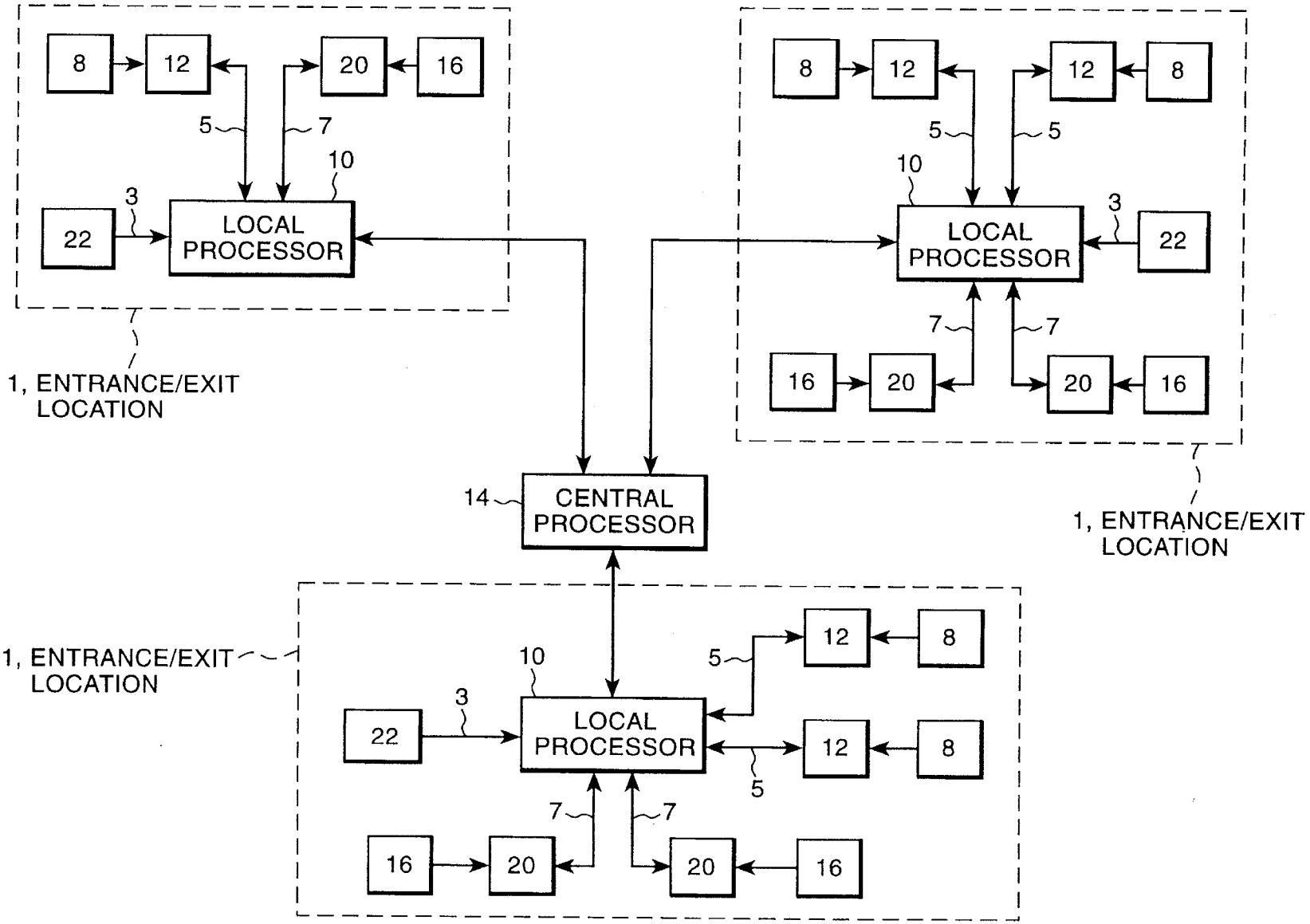
1, ENTRANCE/EXIT LOCATION
LOCAL PROCESSOR
CENTRAL PROCESSOR
1, ENTRANCE/EXIT LOCATION
LOCAL PROCESSOR
1, ENTRANCE/EXIT LOCATION
LOCAL PROCESSOR
8
12
16
20
22
3
5
7
10
14

ACCESS CONTROL SYSTEM

This invention relates to an access control system for a public transport system having a plurality of entrance/exit locations the control system comprising, at each entrance/exit location, at least one entrance gate which is provided with a ticket reading facility, at least one exit gate which is provided with a ticket reading facility, a local data processor, a data communication channel between the or each entrance gate and the local data processor, and a data communication channel between the or each exit gate and the local data processor, the control system further comprising both a data communication network interconnecting the local data processors and at least one ticket issuing facility for issuing single-fare tickets which carry respective identification codes.

A known such system is disclosed in GB-A-1372180. In this known system, in which a ticket issuing facility is provided at each entrance/exit location, single-fare tickets are encoded on purchase with details of exit stations within the system together with further details of validity. The encoding is on a single magnetic track running down the centre of the ticket. Automatic checking takes place at entry to and exit from the system in order to establish validity. Upon presentation of a ticket to the ticket reading facility of an entrance gate the local data processor at the corresponding location inter alia causes some information to be encoded on the ticket aimed at minimising fraudulent use. Each local data processor inter alia stores the serial numbers of the last ten tickets processed at each entrance and exit gate. It then compares the next serial number with these serial numbers and, if it coincides with any of them, the ticket is declared invalid, thereby preventing so-called "pass-back" fraud. If a ticket is found to be invalid for any reason it is rejected.

It is an object of the present invention to enable "read-only" tickets to be employed in a system as defined in the first paragraph.

According to the invention a public transport system as defined in the first paragraph is characterized in that the or each ticket issuing facility is connected to the data communication network.

In that each ticket issuing facility is arranged to communicate, upon issue thereby of a single-fare ticket, the identification code of that ticket and the locations(s) for which the ticket is valid for opening an entrance gate, to the local data processor which is situated at the or each such location, and each such local data processor is arranged to respond by recording that a ticket bearing this identification code is valid for opening an entrance gate at the corresponding location.

in that each entrance gate is arranged to communicate, upon presentation of a single-fare ticket to the ticket reading facility of that gate, the identification code of that ticket to the local data processor at the corresponding location and the local data processor is arranged to respond, if and only if it has a record that a ticket bearing this identification code is valid for opening an entrance gate at the corresponding location, by (i) permitting opening of the corresponding entrance gate and (ii) cancelling its record that a ticket bearing this identification code is valid for opening an entrance gate at the corresponding location, in that each local data processor is arranged to communicate, upon opening of an entrance gate at the corresponding location in response to the presentation of a single-fare ticket to the ticket reading facility of that gate, the identification code of that ticket to the local data processor at the or each location at which that ticket is valid to permit exit from the system and the or each local data processor to which this code is thus communicated is arranged to respond by recording that a ticket bearing this identification code is valid for opening an exit gate at the corresponding location, in that each exit gate is arranged to communicate, upon presentation of a single-fare ticket to the ticket reading facility of that gate, the identification code of that ticket to the local data processor at the corresponding location and the processor is arranged to respond, if and only if it has a record that a ticket bearing this identification code is valid for opening an exit gate at the corresponding location, by (i) permitting opening of the corresponding exit gate and (ii) cancelling its record that a ticket bearing this identification code is valid for opening an exit gate at the corresponding location, and in that each local data processor is arranged to communicate, upon opening of an exit gate at the corresponding location in response to the presentation of a single-fare ticket to the ticket reading facility of that gate, the identification code of that ticket to the local data processor at any other location at which that ticket was valid to permit exit from the system and the or each local data processor to which this code is thus communicated is arranged to respond by cancelling its record that a ticket bearing this identification code is valid for opening an exit gate at the corresponding location.

The term "ticket" is used herein to denote any form of portable carrier for its respective identification code and is not to be understood to imply any particular physical shape or form.

Conveniently the data communication network interconnecting the local data processors may be provided by a central data processor.

An embodiment of the invention will now be described, by way of example, with reference to the accompanying diagrammatic drawing, the single FIGURE of which is a block design of the embodiment.

In FIG. 1 a public transport system, for example a railway system, has a plurality of entrance/exit locations 1 at each of which is provided a ticket issuing facility in the form of a ticket machine 22, for issuing, inter alia, single-fare tickets which carry respective identification codes. These tickets may take the form, for example, of cards which carry a stripe of magnetic material, the respective identification code being in the form of a magnetization pattern of the stripe. Also provided at each location 1 are at least one entrance gate 12 which is provided with a ticket reader 8, at least one exit gate 20 provided with a reader 16, and a local data processor in the form of a computer 10. If the ticket identification codes are in the form of stripe magnetisation patterns the readers 8,16 will each comprise a magnetic read head, although of course other forms of code, for example bar-codes, may be employed, in which case the readers 8, 16 will be constructed accordingly. A data communication channel 3 is provided from each ticket issuing machine 22 to the associated local data processor 10. Similarly a data communication channel 5 is provided between each entrance gate 12/ticket reader 8 combination and the associated local processor 10, and a data communication channel 7 is provided between each exit gate 20/ticket reader 16 combination and the associated local processor 10. A central data processor 14 provides a data communication network interconnecting the local processors of the system.

Each ticket machine 22 is constructed and arranged, each time it issues a single-fare ticket, to communicate the identification code of that ticket and the location(s) 1 for which the ticket is valid for opening an entrance gate to the local processor 10 at the corresponding location 1 via the corresponding channel 3. It may be, for example that the ticket is only valid for entry at the corresponding location 1 or at another similar location. Alternatively it may, for example, be valid for entry at any of the locations lying within a particular zone of the transport system. The communication may be achieved, for example, by means of an appropriate routine included in the program of a microprocessor which controls the operation of the machine 22, the provision of such a controlling microprocessor being otherwise conventional. The relevant local processor is programmed to respond to each such communication by, if the ticket is valid for opening an entrance gate at the corresponding location 1, storing the communicated identification code in memory as a record that a ticket bearing this identification code is valid for opening an entrance gate 12 at the relevant location 1. Moreover the relevant local processor is programmed to communicate, if the ticket is valid to permit entrance to the system at any other location 1, the identification code via the central processor 14 to the local processor 10 at this or these other location(s) and each of the local processors 10 is programmed to respond to such a communication by storing the communicated code in memory as a record that a ticket bearing this identification code is valid for opening an entrance gate 12 at the corresponding location 1.

Each ticket reader 8/entrance gate 12 combination is constructed and arranged to respond to the presentation of a single-fare ticket to the relevant reader 8 by communicating the identification code read from the ticket over the associated communication channel 5 to the associated local processor 10 and this processor is programmed to respond by checking in memory whether it has a record that a ticket bearing this identification code is valid for opening an entrance gate 12 at the corresponding location 1. If and only if it has such a record it sends a signal to the relevant gate 12, which signal causes the gate to open, e.g. by unlocking it. Moreover the relevant processor 10 cancels the relevant record.

Each local processor 10 is programmed to communicate, upon opening of an entrance gate 12 at the corresponding location 1 in response to the presentation of a single-fare ticket to the ticket reader 8 of that gate, the identification code read from the ticket to the local data processor 10 at the or each location at which the ticket is valid to permit exit from the system via central processor 14, and the or each local data processor 10 is programmed to respond to such a communication by storing the code in memory as a record that a ticket bearing this identification code is valid for opening an exit gate at the corresponding location. It may be, for example, that the ticket is valid for exit at any location 1 which lies within a given zone of the transport system. Moreover, each local processor 10 is programmed to further communicate, upon opening of an entrance gate 12 at the corresponding location 1 in response to the presentation of a single-fare ticket to reader 8 of that gate, the identification code read from the ticket to the local data processor 10 at any other location at which that ticket was valid to permit entrance to the system and the or each local processor 10 is programmed to respond to any such communication by cancelling its record in memory that a ticket bearing this identification code is valid for opening an entrance gate 12 at the corresponding location 1.

Each ticket reader 16/exit gate 20 combination is constructed and arranged to respond to the presentation of a single-fare ticket to the relevant reader 16 by communicating the identification code read from the ticket over the associated communication channel 7 to the associated local processor 10 and this processor is programmed to respond by checking in memory whether it has a record that a ticket bearing this identification code is valid for opening an exit gate 20 at the relevant location 1. If and only if it has such a record it sends a signal to the relevant gate 20, which signal causes the gate to open, e.g. by unlocking it. Moreover the relevant processor 10 cancels the relevant record.

Finally, each local processor 10 is programmed to communicate, upon opening of an exit gate 20 at the corresponding location 1 in response to the presentation of a single-fare ticket to the ticket reader 16 of that gate, the identification code read from the ticket to the local data processor 10 at any other location 1 at which that ticket was valid to permit exit from the system, and each local processor 10 is furthermore programmed to respond to any such communication by cancelling its record in memory that a ticket bearing this identification code is valid for opening an exit gate 20 at the corresponding location 1.

It will be evident that the local processors 10 which receive identification codes communicated from other processors 10 in the various circumstances given above will need to know the particular circumstance in which each such communication has been generated. This may be conveniently achieved by arranging that each sending processor 10 attaches a further code to each identification code transmitted, this code being indicative of the particular circumstance in which the relevant identification code is being transmitted.

In the interests of facilitating access to the identification code records held at each local processor 10 it will often be preferable that these identification codes are not themselves stored in the relevant memory as described but rather are merely used as memory addresses, a status code for the corresponding ticket being what is actually stored at the memory location having the relevant address.

It will be appreciated that the presence of the central processor 14 is, although desirable, not essential; it may, for example be replaced by a single communication node or, for example, the various processors 10 may be simply attached to a data communications loop.

Although as described a ticket issuing facility 22 is provided at each location 1 this is not essential. For example, only a single ticket issuing facility may be provided at an arbitrary location remote from any of the locations 1 and communicating directly with the central processor 14 and, through it, with the local processor 10.

I claim:

1. An access control system for a public transport system having a plurality of entrance/exit locations the control system comprising, at each entrance/exit location, at least one entrance gate which is provided with a ticket reading facility, at least one exit gate which is provided with a ticket reading facility, a local data processor, a data communication channel between the or each entrance gate and the local data processor, and a data communication channel between the or each exit gate and the local data processor, the control system further comprising both a data communication network interconnecting the local data processors and at least one ticket issuing facility for issuing single-fare tickets which carry respective identification codes, characterized in that the or each ticket issuing facility is connected to the data communication network.

In that each ticket issuing facility is arranged to communicate, upon issue thereby of a single-fare ticket, the identification code of that ticket and the location(s) for which the ticket is valid for opening an entrance gate, to the local data processor which is situated at the or each such location, and each such local data processor is arranged to respond by recording that a ticket bearing this identification code is valid for opening an entrance gate at the corresponding location, in that each entrance gate is arranged to communicate, upon presentation of a single-fare ticket to the ticket reading facility of that gate, the identification code of that ticket to the local data processor at the corresponding location and the local data processor is arranged to respond, if and only if it has a record that a ticket bearing this identification code is valid for opening an entrance gate at the corresponding location, by (i) permitting opening of the corresponding entrance gate and (ii) cancelling its record that a ticket bearing this identification code is valid for opening an entrance gate at the corresponding location, in that each local data processor is arranged to communicate, upon opening of an entrance gate at the corresponding location in response to the presentation of a single-fare ticket to the ticket reading facility of that gate, the identification code of that ticket to the local data processor at the or each location at which that ticket is valid to permit exit from the system and the or each local data processor to which this code is thus communicated is arranged to respond by recording that a ticket bearing this identification code is valid for opening an exit gate at the corresponding location, in that each exit gate is arranged to communicate, upon presentation of a single-fare ticket to the ticket reading facility of that gate, the identification code of that ticket to the local data processor at the corresponding location and the local data processor is arranged to respond, if and only if it has a record that a ticket bearing this identification code is valid for opening an exit gate at the corresponding location, by (i) permitting opening of the corresponding exit gate and (ii) cancelling its record that a ticket bearing this identification code is valid for opening an exit gate at the corresponding location, and in that each local data processor is arranged to communicate, upon opening of an exit gate at the corresponding location in response to the presentation of a single-fare ticket to the ticket reading facility of that gate, the identification code of that ticket to the local data processor at any other location at which that ticket was valid to permit exit from the system and the or each local data processor to which this code is thus communicated is arranged to respond by cancelling its record that a ticket bearing this identification code is valid for opening an exit gate at the corresponding location.

2. A system as claimed in claim 1 wherein the data communication network interconnecting the local data processors is provided by a central data processor

* * * * *